US006161756A

United States Patent [19]

Upton

[11] Patent Number: 6,161,756

[45] Date of Patent: Dec. 19, 2000

[54] ADJUSTABLE MAILBOX EXTENDER

[76] Inventor: Robert D. Upton, 12 Theresa Ave., North Billerica, Mass. 01862

[21] Appl. No.: 09/244,412

[22] Filed: Feb. 4, 1999

[51] Int. Cl.[7] ..... B65D 91/00

[52] U.S. Cl. ..... 232/39; 248/128; 248/429

[58] Field of Search ..... 232/39, 17, 45; 248/128, 424, 429; D99/32; 211/71, 79, 162; 312/29, 334.1, 334.7, 334.8; 74/88, 98, 126, 128

[56] References Cited

U.S. PATENT DOCUMENTS

| | | | |
|---|---|---|---|
| 911,821 | 2/1909 | Kirk et al. | 312/29 |
| 1,731,682 | 10/1929 | Pendergrass | 248/128 |
| 2,723,098 | 11/1955 | Moore | 248/128 |
| 3,465,994 | 9/1969 | Block | 232/39 |
| 3,497,078 | 2/1970 | Nash . | |
| 3,669,397 | 6/1972 | LeMire | 248/429 X |
| 3,870,262 | 3/1975 | Manning, Jr. | 232/39 X |
| 4,113,213 | 9/1978 | Gay et al. | 248/128 |
| 4,484,705 | 11/1984 | Sande | 232/39 |
| 4,496,123 | 1/1985 | Laramie . | |
| 4,821,952 | 4/1989 | Deciutiis | 248/128 X |
| 4,869,426 | 9/1989 | Powers et al. | 232/39 |
| 5,150,872 | 9/1992 | Isomura | 248/429 |
| 5,259,257 | 11/1993 | Mouri | 248/429 X |
| 5,348,261 | 9/1994 | Nini | 248/424 X |
| 5,641,145 | 6/1997 | Droulon et al. | 248/429 |
| 5,678,757 | 10/1997 | Martin | 232/39 X |
| 5,755,421 | 5/1998 | Meier et al. | 248/429 |
| 5,813,648 | 9/1998 | Moradell et al. | 248/424 |
| 5,918,846 | 7/1999 | Garrido | 248/429 |
| 5,931,436 | 8/1999 | Rohee | 248/429 X |

*Primary Examiner*—Terry Lee Melius
*Assistant Examiner*—William L. Miller

[57] ABSTRACT

A adjustable mailbox extender for permitting adjustable extension of a mailbox from its support post. The adjustable mailbox extender includes an elongate bottom track designed for attachment to a support structure and a top track slidably mounted on the bottom track to permit sliding of the top track in a direction along the longitudinal axis of the bottom track. The top portion of the top track is designed for attaching a mailbox thereto adjacent a first end of the top track.

15 Claims, 4 Drawing Sheets

27
41
30
31
32
44
18
19
15
20
42
43
45
46
13
14
12

ADJUSTABLE MAILBOX EXTENDER

BACKGROUND OF THE INVENTION

1. Field of the Invention

The present invention relates to mailbox extension devices and more particularly pertains to a new adjustable mailbox extender for permitting adjustable extension of a mailbox from its support post.

2. Description of the Prior Art

The use of mailbox extension devices is known in the prior art. More specifically, mailbox extension devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,496,123 by Laramie; U.S. Pat. No. 3,497,078 by Nash; U.S. Pat. No. Des. 376,464 by Cunningham et al.; U.S. Pat. No. 4,714,192 by Harlow, Jr. et al.; U.S. Pat. No. 4,300,739 by Sande; and U.S. Pat. No. 3,134,538 by Fibus.

While these devices fulfill their respective, particular objectives and requirements, the aforementioned patents do not disclose a new adjustable mailbox extender. The inventive device includes an elongate bottom track designed for attachment to a support structure and a top track slidably mounted on the bottom track to permit sliding of the top track in a direction along the longitudinal axis of the bottom track. The top portion of the top track is designed for attaching a mailbox thereto adjacent a first end of the top track.

In these respects, the adjustable mailbox extender according to the present invention substantially departs from the conventional concepts and designs of the prior art, and in so doing provides an apparatus primarily developed for the purpose of permitting adjustable extension of a mailbox from its support post.

SUMMARY OF THE INVENTION

In view of the foregoing disadvantages inherent in the known types of mailbox extension devices now present in the prior art, the present invention provides a new adjustable mailbox extender construction wherein the same can be utilized for permitting adjustable extension of a mailbox from its support post.

The general purpose of the present invention, which will be described subsequently in greater detail, is to provide a new adjustable mailbox extender apparatus and method which has many of the advantages of the mailbox extension devices mentioned heretofore and many novel features that result in a new adjustable mailbox extender which is not anticipated, rendered obvious, suggested, or even implied by any of the prior art mailbox extension devices, either alone or in any combination thereof.

To attain this, the present invention generally comprises an elongate bottom track designed for attachment to a support structure and a top track slidably mounted on the bottom track to permit sliding of the top track in a direction along the longitudinal axis of the bottom track. The top portion of the top track is designed for attaching a mailbox thereto adjacent a first end of the top track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable mailbox extender apparatus and method which has many of the advantages of the mailbox extension devices mentioned heretofore and many novel features that result in a new adjustable mailbox extender which is not anticipated, rendered obvious, suggested, or even implied by any of the prior art mailbox extension devices, either alone or in any combination thereof.

It is another object of the present invention to provide a new adjustable mailbox extender which may be easily and efficiently manufactured and marketed.

It is a further object of the present invention to provide a new adjustable mailbox extender which is of a durable and reliable construction.

An even further object of the present invention is to provide a new adjustable mailbox extender which is susceptible of a low cost of manufacture with regard to both materials and labor, and which accordingly is then susceptible of low prices of sale to the consuming public, thereby making such adjustable mailbox extender economically available to the buying public.

Still yet another object of the present invention is to provide a new adjustable mailbox extender which provides in the apparatuses and methods of the prior art some of the advantage thereof, while simultaneously overcoming some of the disadvantages normally associated therewith.

Still another object of the present invention is to provide a new adjustable mailbox extender for permitting adjustable extension of a mailbox from its support post.

Yet another object of the present invention is to provide a new adjustable mailbox extender which includes an elongate bottom track designed for attachment to a support structure and a top track slidably mounted on the bottom track to permit sliding of the top track in a direction along the longitudinal axis of the bottom track. The top portion of the top track is designed for attaching a mailbox thereto adjacent a first end of the top track.

Sill yet another object of the present invention is to provide a new adjustable mailbox extender that lets a user position a mailbox closer to the street during winter months so that the mailbox extends over any curbside snow banks to let postal carries and newspaper delivers have easier access to the mailbox.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
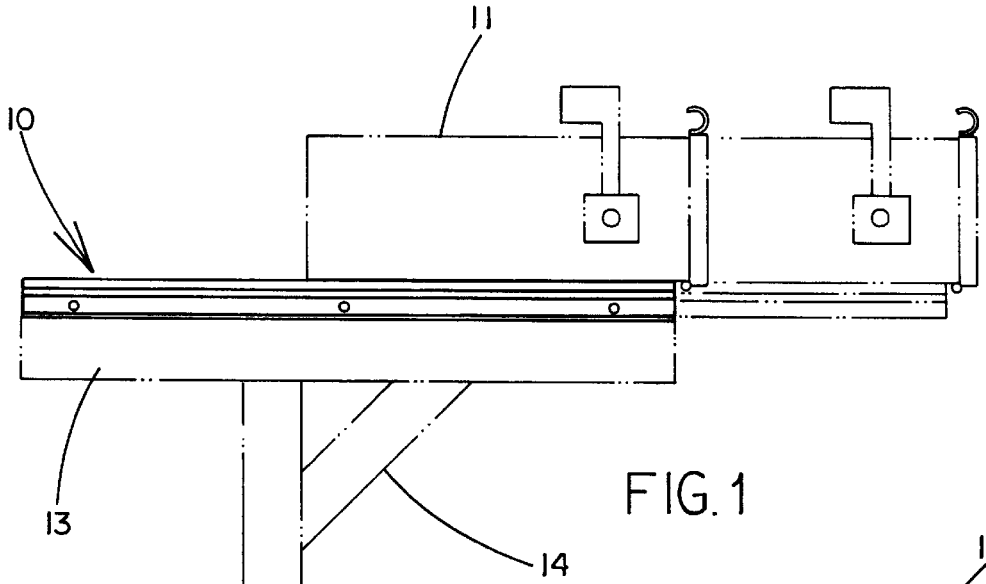
FIG. 1 is a schematic side view of a new adjustable mailbox extender in use according to the present invention illustrating the sliding thereof to extend a mailbox further out from the support structure.
Figure 2:
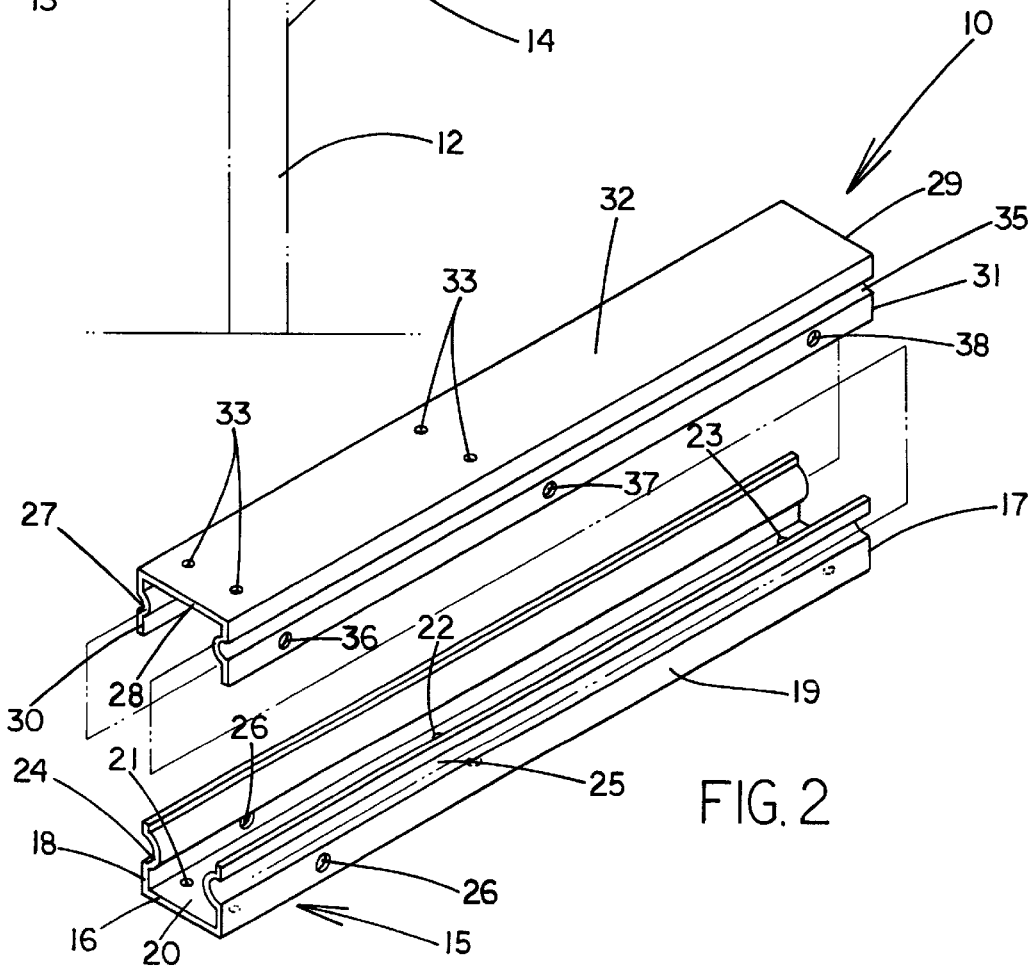
FIG. 2 is a schematic exploded perspective view of the present invention.
Figure 3:
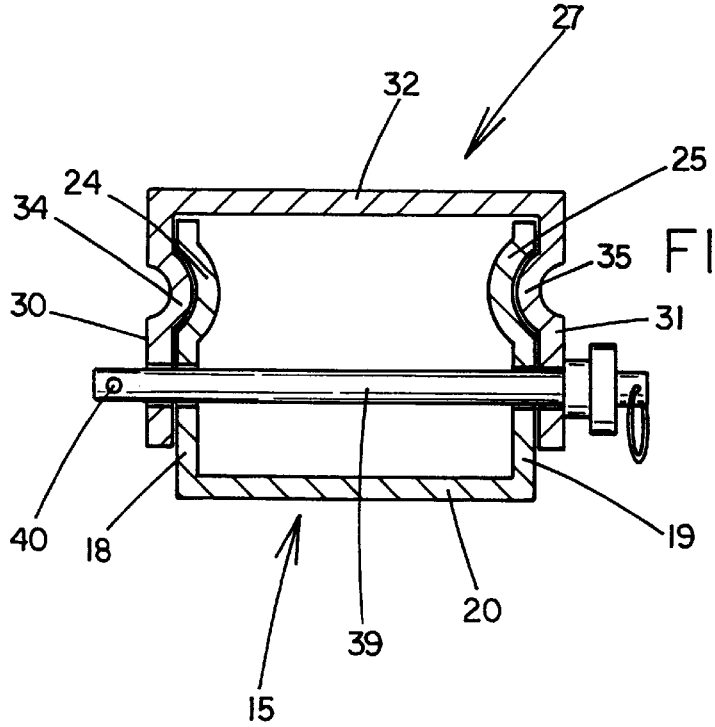
FIG. 3 is a schematic cross sectional view of the present invention taken from line 3—3 of FIG. 4.
Figure 4:
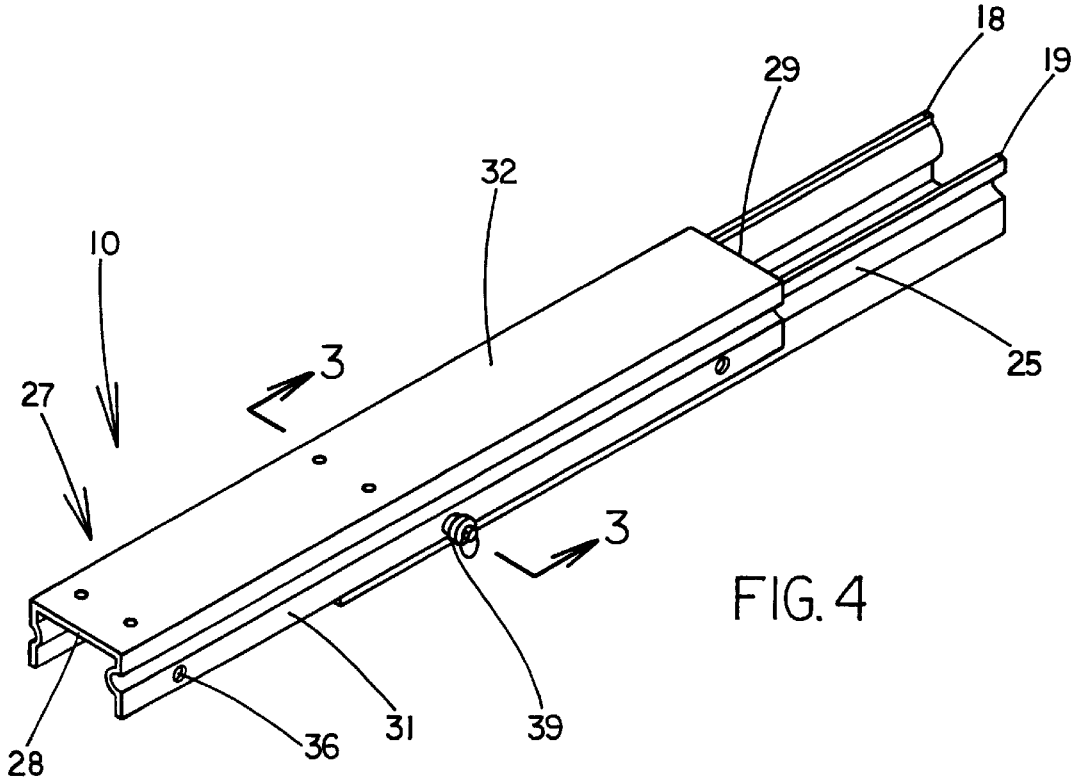
FIG. 4 is a schematic perspective view of the present invention.
Figure 5:
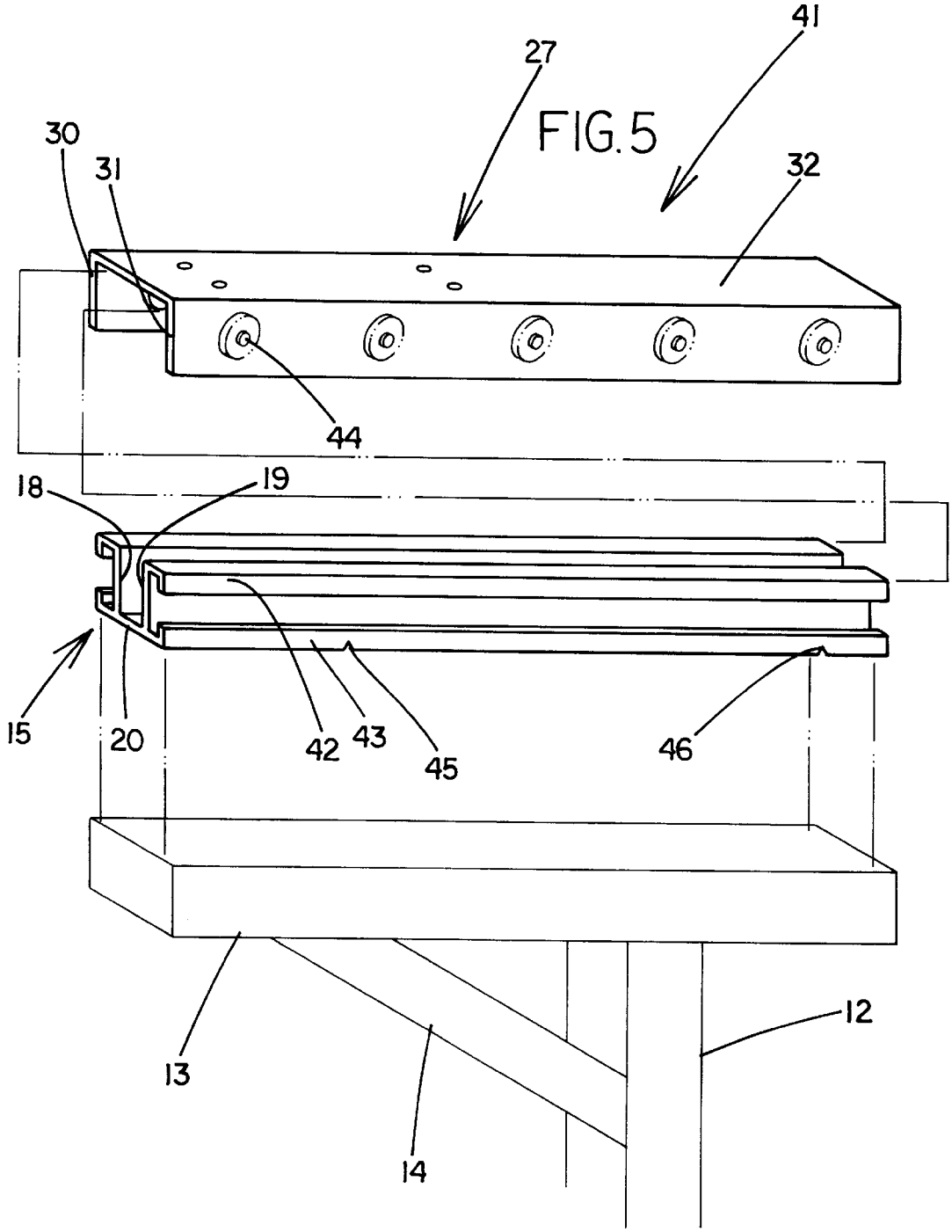
FIG. 5 is a schematic exploded perspective view of a second embodiment of the present invention.
Figure 6:
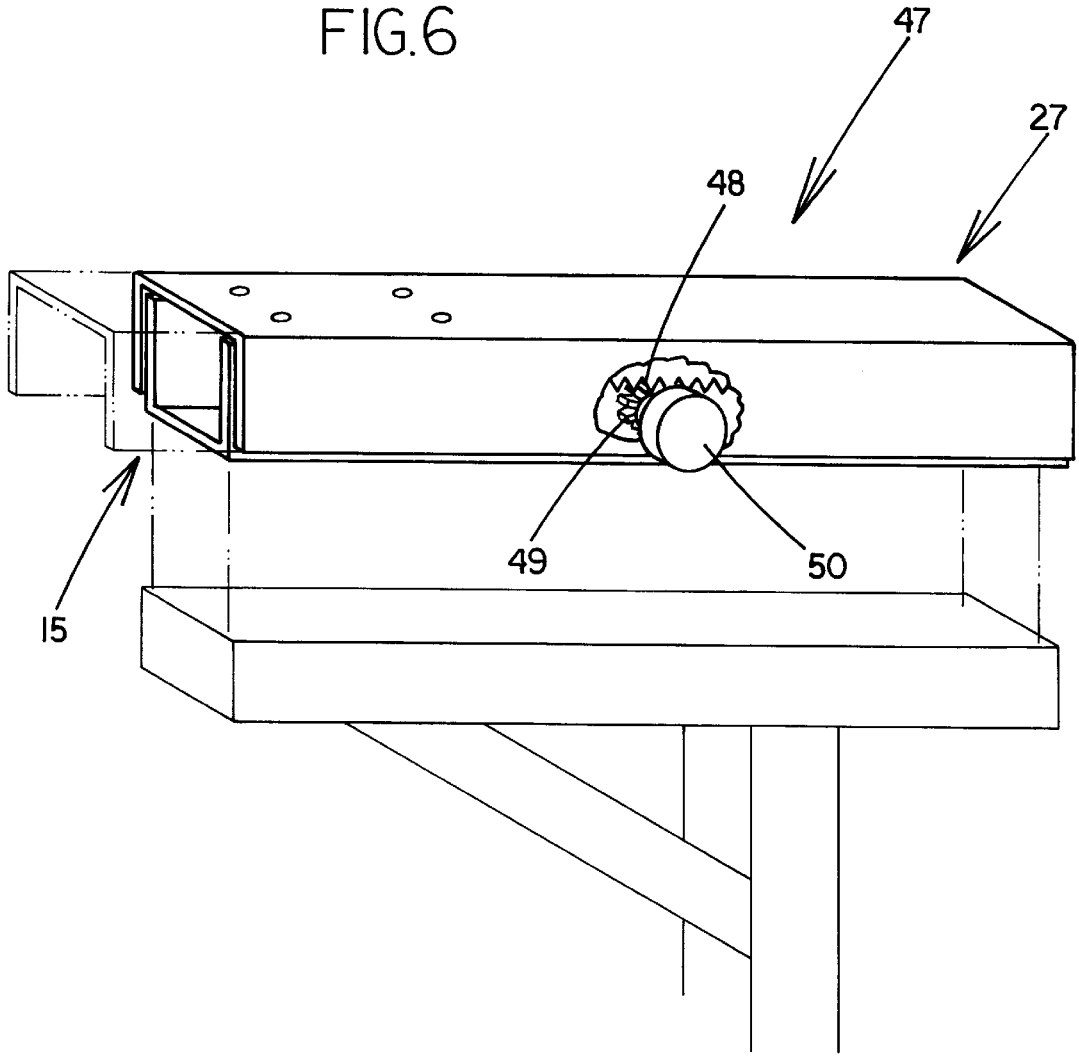
FIG. 6 is a schematic perspective view of a third embodiment of the present invention.

With reference now to the drawings, and in particular to FIGS. 1 through 6 thereof, a new adjustable mailbox extender embodying the principles and concepts of the present invention and generally designated by the reference numeral 10 will be described.

As best illustrated in FIGS. 1 through 6, the adjustable mailbox extender 10 generally comprises an elongate bottom track designed for attachment to a support structure and a top track slidably mounted on the bottom track to permit sliding of the top track in a direction along the longitudinal axis of the bottom track. The top portion of the top track is designed for attaching a mailbox thereto adjacent a first end of the top track.

In use, the adjustable mailbox extender 10 is designed for extending a mailbox 11 further into the street from a support structure. The support structure ideally comprises a support post 12 vertically upwardly extending from a support surface such as a ground surface. A mounting post 13 having opposite forwards and rearward ends is coupled to the upper end of the support post and is extended substantially perpendicular to the support post and substantially horizontal to the support surface. Preferably, a mounting brace 14 is coupled to the mounting post and the support post. The mounting brace is extended an acute angle to the mounting post and at an acute angle to the support brace.

In closer detail, adjustable mailbox extender comprises an elongate bottom track 15 having a pair of opposite ends 16, 17, and a longitudinal axis extending between the ends of the bottom track. The bottom track has a length defined along the longitudinal axis of the bottom track between the ends of the track. Ideally, the length of the bottom track is about 36 inches. The bottom track is a generally rectangular U-shape and also has a spaced apart pair of upwardly extending rails 18, 19 extending between the ends of the bottom track and a bottom portion 20 connecting the rails of the bottom track together.

The bottom portion of the bottom track is coupled to the mounting post such that the bottom track and the mounting post extend substantially parallel with one another. A first of the ends of the bottom track is positioned adjacent the forwards end of the mounting post and a second of the ends of the bottom track is positioned towards the rearwards end of the mounting post. Preferably, the bottom portion of the bottom track has a plurality of mounting holes 21, 22, 23 therethrough to permit extension therethrough of fasteners to couple the bottom portion of the bottom track to the mounting post. Ideally, the mounting holes of the bottom track comprises first, second, and third pairs of mounting holes. The first pair of mounting holes 21 is positioned towards one of the ends of the bottom track. The third pair of mounting holes 23 is positioned towards the other end of the bottom track. The second pair 22 of mounting holes is positioned between the first and third pairs of mounting holes.

The rails of the bottom track are preferably extended substantially parallel to one another and substantially perpendicular to the bottom portion of the bottom track. The rails of the bottom track each have an outwardly facing elongate guide channel 24, 25 extending between the ends of the bottom track. Each of the guide channels has a generally U-shaped transverse cross section taken substantially perpendicular to the longitudinal axis of the bottom track. The rails of the bottom track each also have has a securing hole 26 extending therethrough. The securing holes of the bottom track are substantially coaxial with one another. The securing holes of the bottom track are positioned towards the first end of the bottom track. Ideally, the securing holes of the bottom track are spaced about 9 inches away from the first end of the bottom track.

An elongate top track 27 has a pair of opposite ends 28, 29, and a longitudinal axis extending between the ends of the top track. The top track has a length defined along the longitudinal axis of the top track between the ends of the track. Ideally, the length of the top track is also about 36 inches. The top track is a generally rectangular U-shape and has a spaced apart pair of downwardly extending rails 30, 31 extending between the ends of the top track and a top portion 32 connecting the rails of the top track together.

The mailbox is coupled to the top portion of the top track adjacent a first end of the top track. Preferably, the top portion of the top track has a plurality of mounting holes 33 therethrough to permit extension therethrough of fasteners to couple the top portion of the top track to the mailbox. The mounting holes of the top track ideally comprise spaced apart first and second pairs of mounting holes positioned towards the first end of the top track.

The rails of the top track are extended substantially parallel to one another and substantially perpendicular to the top portion of the top track. The rails of the top track each have an inwardly extending elongate guide groove 34, 35 extending between the ends of the top track. Each of the guide channels has a generally U-shaped transverse cross section taken substantially perpendicular to the longitudinal axis of the top track.

The rails of the top track each have a plurality of securing holes 36, 37, 38 extending therethrough. Each securing hole of one of the rails of the top track is associated with a securing hole of the other of the rails of the top track. Each pair of associated securing holes of the top track is substantially coaxial with one another. The pairs of associated securing holes of the top track comprises first, second, and third pairs of associated securing holes. The first pair of associated securing holes 36 is positioned towards the first end of the top track. The third pair of associated securing holes 38 is positioned towards a second of the ends of the top track. The second pair of associated securing holes 37 is positioned between the first and third pairs of the associated securing holes. Ideally, the first pair of associated securing holes is positioned about 9 inches away from the first end of the top track, the third paid of associated securing holes is positioned about 3 inches away from the second end of the top track, and the second pair of associated securing holes is positioned about 12 inches away from both the first and second pairs of associated securing holes.

The top track is slidably mounted on the bottom track to permit sliding of the top track in a direction along the longitudinal axis of the bottom track with the rails of the bottom track positioned between the rails of the top track. The rails of the top and bottom tracks are extended substantially parallel to one another. The top and bottom portions of the top and bottom tracks are extended substantially parallel to one another. The guide ridges of the top track each are slidably inserted into guide grooves of the bottom track. One of the guide ridges is slidably inserted into one of the guide grooves and the other of the guide ridges is slidably inserted into the other of the guide grooves. The guide ridges and guide grooves are of complementary cooperating transverse cross section preventing lifting of the top track from the bottom track without relative sliding motion therebetween.

A securing pin 39 is extended through the pair of securing holes of the bottom track and one of the pairs of associated securing holes of the top track positioned substantially coaxial with the pair of securing holes of the bottom track, the securing pin holding the top track and the bottom track in a fixed position with one another to prevent sliding of the top track with respect to the bottom track. Optionally the securing pin may having a hole at one end to extend a padlock therethrough to prevent unauthorized removal of the securing pin.

In a second embodiment 41 of the adjustable mailbox extender, the rails of the bottom track each have a generally C-shaped transverse cross section and each has a pair of opposing arms 42, 43 defining a guide channel therebetween. The rails of the top track each have a plurality of inwardly facing wheels 44 rotationally mounted thereto. The wheels of one of the rails of the top track are positioned in the guide channel of one of the rails of the bottom track and the wheels of the other of the rails of the top track are positioned in the guide channel of the other of the rails of the bottom track to permit rolling of the wheels of the top track in the guide channels of the bottom track. Preferably, the rails of the bottom track each has a spaced apart pair of stops 45, 46 extending into the guide channel of the respective rail of the bottom track. In use, the stops of the rails prevent rolling of the wheels of the top track beyond the pair of stops.

In a third embodiment 47, the top portion of the top track has an elongate row of teeth 48 extending between the ends of the top track. The bottom track has a toothed wheel gear 49 rotationally mounted thereto between the rails of the bottom track. The toothed wheel gear of the bottom track engages the row of teeth of the top track such that rotation of the toothed wheel gear moves the top track with respect to the bottom track in the direction of rotation of the toothed wheel gear. The toothed wheel hear has a turn knob 50 outwardly extending through one of the rails of the bottom track and the adjacent rail of the top track, the turn knob permitting a user to rotate the toothed wheel gear therewith.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox extension system, comprising:

an elongate bottom track having a pair of opposite ends, and a longitudinal axis extending between said ends of said bottom track;

said bottom track being a generally rectangular U-shape and having a spaced apart pair of upwardly extending rails extending between said ends of said bottom track and a bottom portion connecting said rails of said bottom track together;

said bottom portion of said bottom track being adapted for attachment to a support structure;

an elongate top track having a pair of opposite ends, and a longitudinal axis extending between said ends of said top track;

said top track being a generally rectangular U-shape and having a spaced apart pair of downwardly extending rails extending between said ends of said top track and a top portion connecting said rails of said top track together;

said top portion of said top track being adapted for attaching a mailbox thereto adjacent a first end of said top track;

said top track being slidably mounted on said bottom track to permit sliding of said top track in a direction along said longitudinal axis of said bottom track;

said rails of said bottom track being positioned between said rails of said top track;

wherein said rails of said bottom track each have a generally C-shaped transverse cross section and each having a pair of opposing arms defining a guide channel therebetween, said rails of said top track each having a plurality of inwardly facing wheels rotationally mounted thereto, said wheels of one of said rails of said top track being positioned in said guide channel of one of said rails of said bottom track and said wheels of the other of said rails of said top track being positioned in said guide channel of the other of said rails of said bottom track to permit rolling of said wheels of said top track in said guide channels of said bottom track;

wherein said rails of said bottom track each having a spaced apart pair of stops extending into said guide channel of said respective rail of said bottom track, said stops of said rails preventing rolling of said wheels of said top track beyond said pair of stops.

2. The mailbox extension system of claim 1, further comprising a support post adapted for upwardly extending from a support surface, said support post having an upper end, a mounting post being coupled to said upper end of said support post, said mounting post being extended substantially perpendicular to said support post, said mounting post having opposite forward and rearward ends, said bottom portion of said bottom track being coupled to said mounting post such that said bottom track and said mounting post extend substantially parallel with one another, a first of said ends of said bottom track being positioned adjacent said forward end of said mounting post, a second of said ends of said bottom track being positioned towards said rearward end of said mounting post.

3. The mailbox extension system of claim 2, further comprising a mounting brace being coupled to said mounting post and said support post, said mounting brace being extended an acute angle to said mounting post and at an acute angle to a support brace.

4. The mailbox extension system of claim 1, wherein said bottom portion of said bottom track has a plurality of mounting holes therethrough to permit extension therethrough of fasteners to couple said bottom portion of said bottom track to a support structure.

5. The mailbox extension system of claim 4, wherein said mounting holes of said bottom track comprise first, second, and third pairs of mounting holes, said first pair of mounting holes being positioned towards one of said ends of said bottom track, said third pair of mounting holes being positioned towards the other end of said bottom track, said second pair of mounting holes being positioned between said first and third pairs of mounting holes.

6. The mailbox extension system of claim 1, wherein said rails of said bottom track each having an outwardly facing elongate guide channel extending between said ends of said bottom track, said rails of said top track each having an inwardly extending elongate guide groove extending between said ends of said top track, said guide grooves of said top track each being slidably inserted into guide channels of said bottom track, one of said guide grooves being slidably inserted into one of said guide channels and the other of said guide grooves being slidably inserted into the other of said guide channels.

7. The mailbox extension system of claim 6, wherein said guide channels and guide grooves are of complementary cooperating transverse cross section preventing lifting of said top track from said bottom track without relative sliding motion therebetween.

8. The mailbox extension system of claim 1, further comprising a support post adapted for upwardly extending from a support surface, said support post having an upper end, a mounting post being coupled to said upper end of said support post, said mounting post being extended substantially perpendicular to said support post, said mounting post having opposite forward and rearward ends, said bottom portion of said bottom track being coupled to said mounting post such that said bottom track and said mounting post extend substantially parallel with one another, a first of said ends of said bottom track being positioned adjacent said forward end of said mounting post, a second of said ends of said bottom track being positioned towards said rearward end of said mounting post;

a mounting brace being coupled to said mounting post and said support post, said mounting brace being extended an acute angle to said mounting post and at an acute angle to a support brace;

wherein said bottom portion of said bottom track has a plurality of mounting holes therethrough to permit extension therethrough of fasteners to couple said bottom portion of said bottom track to a support structure;

wherein said mounting holes of said bottom track comprise first, second, and third pairs of mounting holes, said first pair of mounting holes being positioned towards one of said ends of said bottom track, said third pair of mounting holes being positioned towards the other end of said bottom track, said second pair of mounting holes being positioned between said first and third pairs of mounting holes.

9. A mailbox extension system, comprising:

a mailbox;

a support post adapted for vertically upwardly extending from a support surface;

said support post having an upper end;

a mounting post being coupled to said upper end of said support post, said mounting post being extended substantially perpendicular to said support post;

a mounting brace being coupled to said mounting post and said support post, said mounting brace being extended an acute angle to said mounting post and at an acute angle to a support brace;

said mounting post having opposite forward and rearward ends;

a sliding assembly comprising:

an elongate bottom track having a pair of opposite ends, and a longitudinal axis extending between said ends of said bottom track;

said bottom track having a length defined along said longitudinal axis of said bottom track between said ends of said track;

said bottom track being a generally rectangular U-shape and having a spaced apart pair of upwardly extending rails extending between said ends of said bottom track and a bottom portion connecting said rails of said bottom track together;

said bottom portion of said bottom track being coupled to said mounting post such that said bottom track and said mounting post extend substantially parallel with one another;

a first of said ends of said bottom track being positioned adjacent said forward end of said mounting post, a second of said ends of said bottom track being positioned towards said rearward end of said mounting post;

said bottom portion of said bottom track having a plurality of mounting holes therethrough to permit extension therethrough of fasteners to couple said bottom portion of said bottom track to said mounting post;

said mounting holes of said bottom track comprising first, second, and third pairs of mounting holes, said first pair of mounting holes being positioned towards one of said ends of said bottom track, said third pair of mounting holes being positioned towards the other end of said bottom track, said second pair of mounting holes being positioned between said first and third pairs of mounting holes;

said rails of said bottom track being extended substantially parallel to one another and substantially perpendicular to said bottom portion of said bottom track;

said rails of said bottom track each having an outwardly facing elongate guide channel extending between said ends of said bottom track, each of said guide channels having a generally U-shaped transverse cross section taken substantially perpendicular to said longitudinal axis of said bottom track;

said rails of said bottom track each having a securing hole extending therethrough, said securing holes of said bottom track being substantially coaxial with one another, said securing holes of said bottom track being positioned towards said first end of said bottom track;

an elongate top track having a pair of opposite ends, and a longitudinal axis extending between said ends of said top track;

said top track having a length defined along said longitudinal axis of said top track between said ends of said track, said lengths of said top and bottom tracks being about equal to one another;

said top track being a generally rectangular U-shape and having a spaced apart pair of downwardly extending rails extending between said ends of said top track and a top portion connecting said rails of said top track together;

said mailbox being coupled to said top portion of said top track adjacent a first end of said top track;

said top portion of said top track having a plurality of mounting holes therethrough to permit extension therethrough of fasteners to couple said top portion of said top track to said mailbox;

said mounting holes of said top track comprising spaced apart first and second pairs of mounting holes positioned towards said first end of said top track;

said rails of said top track being extended substantially parallel to one another and substantially perpendicular to said top portion of said top track;

said rails of said top track each having an inwardly extending elongate guide groove extending between said ends of said top track, each of said guide grooves having a generally U-shaped transverse cross section taken substantially perpendicular to said longitudinal axis of said top track;

said rails of said top track each having a plurality of securing holes extending therethrough, each securing hole of one of said rails of said top track being associated with a securing hole of the other of said rails of said top track, each pair of associated securing holes of said top track being substantially coaxial with one another;

said pairs of associated securing holes of said top track comprising first, second, and third pairs of associated securing holes, said first pair of associated securing holes being positioned towards said first end of said top track, said third pair of associated securing holes being positioned towards a second of said ends of said top track, said second pair of associated securing holes being positioned between said first and third pairs of said associated securing holes;

said top track being slidably mounted on said bottom track to permit sliding of said top track in a direction along said longitudinal axis of said bottom track;

said rails of said bottom track being positioned between said rails of said top track;

said rails of said top and bottom tracks being extended substantially parallel to one another;

said top and bottom portions of said top and bottom tracks being extended substantially parallel to one another;

said guide grooves of said top track each being slidably inserted into said guide channels of said bottom track, one of said guide grooves being slidably inserted into one of said guide channels and the other of said guide grooves being slidably inserted into the other of said guide channels;

said guide channels and guide grooves being of complementary cooperating transverse cross section preventing lifting of said top track from said bottom track without relative sliding motion therebetween; and a securing pin being extended through said pair of securing holes of said bottom track and one of said pairs of associated securing holes of said top track positioned substantially coaxial with said pair of securing holes of said bottom track, said securing pin holding said top track and said bottom track in a fixed position with one another to prevent sliding of said top track with respect to said bottom track.

10. A mailbox extension system, comprising:

an elongate bottom track having a pair of opposite ends, and a longitudinal axis extending between said ends of said bottom track;

said bottom track being a generally rectangular U-shape and having a spaced apart pair of upwardly extending rails extending between said ends of said bottom track and a bottom portion connecting said rails of said bottom track together;

said bottom portion of said bottom track being adapted for attachment to a support structure;

an elongate top track having a pair of opposite ends, and a longitudinal axis extending between said ends of said top track;

said top track being a generally rectangular U-shape and having a spaced apart pair of downwardly extending rails extending between said ends of said top track and a top portion connecting said rails of said top track together;

said top portion of said top track being adapted for attaching a mailbox thereto adjacent a first end of said top track;

said top track being slidably mounted on said bottom track to permit sliding of said top track in a direction along said longitudinal axis of said bottom track;

said rails of said bottom track being positioned between said rails of said top track;

wherein one of said rails of said bottom track has an elongate row of teeth extending between said ends of said bottom track, said top track having a toothed wheel gear rotationally mounted thereto between said rails of said bottom track, said toothed wheel gear of said top track engaging said row of teeth of said bottom track such that rotation of said toothed wheel gear moves said top track with respect to said bottom track in the direction opposite the rotation of said toothed wheel gear;

wherein said toothed wheel gear has a turn knob outwardly extending through one of said side rails of said top track, said turn knob permitting a user to rotate said toothed wheel gear therewith.

11. The mailbox extension system of claim 10, further comprising a support post adapted for upwardly extending from a support surface, said support post having an upper end, a mounting post being coupled to said upper end of said support post, said mounting post being extended substantially perpendicular to said support post, said mounting post having opposite forward and rearward ends, said bottom portion of said bottom track being coupled to said mounting post such that said bottom track and said mounting post extend substantially parallel with one another, a first of said ends of said bottom track being positioned adjacent said forward end of said mounting post, a second of said ends of said bottom track being positioned towards said rearward end of said mounting post;

a mounting brace being coupled to said mounting post and said support post, said mounting brace being extended an acute angle to said mounting post and at an acute angle to a support brace;

wherein said bottom portion of said bottom track has a plurality of mounting holes therethrough to permit extension therethrough of fasteners to couple said bottom portion of said bottom track to a support structure;

wherein said mounting holes of said bottom track comprise first, second, and third pairs of mounting holes, said first pair of mounting holes being positioned towards one of said ends of said bottom track, said third pair of mounting holes being positioned towards the other end of said bottom track, said second pair of mounting holes being positioned between said first and third pairs of mounting holes.

12. The mailbox extension system of claim 10, further comprising a support post adapted for upwardly extending from a support surface, said support post having an upper end, a mounting post being coupled to said upper end of said support post, said mounting post being extended substantially perpendicular to said support post, said mounting post having opposite forward and rearward ends, said bottom portion of said bottom track being coupled to said mounting post such that said bottom track and said mounting post extend substantially parallel with one another, a first of said ends of said bottom track being positioned adjacent said forward end of said mounting post, a second of said ends of said bottom track being positioned towards said rearward end of said mounting post.

13. The mailbox extension system of claim 12, further comprising a mounting brace being coupled to said mounting post and said support post, said mounting brace being extended an acute angle to said mounting post and at an acute angle to a support brace.

14. The mailbox extension system of claim 10, wherein said bottom portion of said bottom track has a plurality of mounting holes therethrough to permit extension therethrough of fasteners to couple said bottom portion of said bottom track to a support structure.

15. The mailbox extension system of claim 14, wherein said mounting holes of said bottom track comprise first, second, and third pairs of mounting holes, said first pair of mounting holes being positioned towards one of said ends of said bottom track, said third pair of mounting holes being positioned towards the other end of said bottom track, said second pair of mounting holes being positioned between said first and third pairs of mounting holes.

* * * * *